United States Patent [19]

Kojima et al.

[11] Patent Number: 4,806,739

[45] Date of Patent: Feb. 21, 1989

[54] PLATE-LIKE CERAMIC HEATER

[75] Inventors: Takao Kojima; Hiroyuki Ishiguro; Yoshiki Kawachi; Tetsusyo Yamada, all of Nagoya, Japan

[73] Assignee: NGK Spark Plug Co., Ltd., Nagoya, Japan

[21] Appl. No.: 136,438

[22] Filed: Dec. 17, 1987

Related U.S. Application Data

[63] Continuation of Ser. No. 805,808, Dec. 6, 1985, abandoned.

[30] Foreign Application Priority Data

Dec. 11, 1984 [JP] Japan ..... 59-260069

[51] Int. Cl.[4] ..... H05B 3/26

[52] U.S. Cl. ..... 219/543; 219/553; 219/345

[58] Field of Search ..... 217/543, 544, 552, 553, 217/538, 345; 338/308, 309

[56] References Cited

U.S. PATENT DOCUMENTS

| | | | |
|---|---|---|---|
| 3,978,316 | 8/1976 | Rose et al. | 219/543 |
| 4,139,833 | 2/1979 | Kirsch | 338/308 |
| 4,505,805 | 3/1985 | Mase et al. | 219/553 X |
| 4,510,036 | 4/1985 | Takeuchi et al. | 204/425 |

*Primary Examiner*—Teresa J. Walberg

*Attorney, Agent, or Firm*—Wegner & Bretschneider

[57] ABSTRACT

A heater including an electron-conductive pattern designed to generate heat, which has a partially and/or entirely stabilized $ZrO_2$-base substrate, an $Al_2O_3$-base coating layer disposed on the surface of the substrate, and an electron-conductive pattern to generate heat disposed on the coating layer.

12 Claims, 2 Drawing Sheets

*1. $ZrO_2$-base substrate

*2. $Al_2O_3$-coating layer

*3. green size/sintered size

PLATE-LIKE CERAMIC HEATER

This application is a continuation of U.S. applicatin Ser. No. 805,808, filed Dec. 6, 1985, new abandoned.

FIELD OF THE INVENTION

The present invention relates to a plate-like ceramic heater and, more particularly, to means for improving the durability of a plate-like ceramic heater in which a ceramic substrate is provided thereon with an electron-conductive pattern for the purpose of generating heat.

BACKGROUND

In the prior art, there has been produced a heater having on a substrate composed mainly of $Al_2O_3$ an electron-conductive pattern desired to generate heat. However, when current (direct current) is continued to be applied through the heater, blackening or peeling-off occurs in the vicinity of the cathode terminal. There occur an increase in the resistance and hence partial heat generation, which may result in deterioration of the durability of the heater.

SUMMARY OF THE INVENTION

Although still unclarified, we think that the reason for such blackening is attributable to the reduction of $A_2O_3$ or impurities therein, and to the catalytic action upon the reduction reaction of Pt in the pattern diffusing into the substrate.

On the other hand, changing of the substrate material from the $Al_2O_3$-base, material to a $ZrO_2$-base material serves to prevent blackening of the cathode terminal portion due to the application of current and to decrease the power required or heating an object, thereby extending the durable life of the heater to an extreme degree. This is because (1) the $ZrO_2$-base material is oxygen-conductive, and (2) the $ZrO_2$-base substrate dissipates less heat since the $ZrO_2$-base material has a lower thermal conductivity than the $Al_2O_3$-base material. However, the electric resistance of the $ZrO_2$-base material becomes very small at elevated temperatures, so that the anode and cathode terminal portions of the electron-conductive pattern have to be insulated. For that reason, these has been a demand for improving the insulating properties at elevated temperatures of the $ZrO_2$-base substrate without causing deterioration of the durable life of the heater at the time of the application of current.

An object of the present invention is to eliminate the problems in the prior art referred to in the Background of the Invention. It has been found by the present inventors that this object is achieved by providing a coating layer of $A_2O_3$ having a suitable thickness on the entire portion or at least an electron-conducive pattern portion of the surface of a partially and/or entirely stabilized $ZrO_2$-base substrate, and further providing on said coating layer an electron-conductive pattern to generate heat.

BRIEF DESCRIPTION OF THE DRAWINGS

FIG. 1 showing an embodiment wherein an embodiment wherein an $A_2O_3$ layer is applied to the heat-generating pattern portion alone, and FIG. 2 showing an embodiment wherein an $A_2O_3$ layer is applied on the entire surface of the $ZrO_2$-base substrate.

DETAILED DESCRIPTION OF THE INVENTION

A dense $A_2O_3$ layer is provided on the entire surface, or only on the part of the surface whereon the electron-conductive pattern is to be disposed, of the $ZrO_2$-base substrate, whereby it is possible to prevent the current from escaping due to the increased conductivity of $ZrO_2$ at elevated temperatures. However, too thick an $A_2O_3$ layer lessens the effect of the $ZrO_2$-base substrate, while too thin an $A_2O_3$ layer causes deterioration of the insulation of the heater so that an inadequate result is obtained. Thus, the $A_2O_3$ layer according to the present invention should have a thickness of preferably 20 to 70 microns, most preferably 30 to 50 microns.

The raw material for the $Al_2O_3$-base coating layer according to the present invention contains $A_2O_3$ having a purity of no lower than 90%, and may contain $SiO_2$, MgO, CaO, $ZrO_2$, etc. in addition thereto. In particular, the addition of a slight amount of $ZrO_2$ serves to improve the integrality (or binding force) of that layer with respect to the $ZrO_2$-base substrate and, hence, reduce the sintering shrinkage modulus of that layer.

The $ZrO_2$-base substrate used is formed of sintered bodies of partially stabilized or entirely stabilized $ZrO_2$, in which $Y_2O_3$, CaO, MgO, etc. are added to $ZrO_2$. The electron-conductive pattern may be obtained by forming a paste composed mainly of Pt, Rh, W, Mo or a mixture thereof (which may include some amounts of oxides) on the $Al_2O_3$-base coating layer by the known techniques such as screen printing, etc., followed by heating. How to provide the electron-conductive pattern per se is well known in the art, so a more detailed description is omitted from this application as unnecessary.

Figure 1:
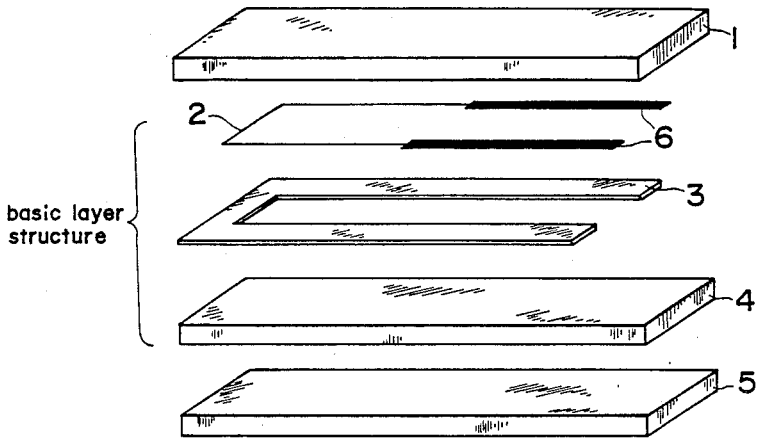
FIGS. 1 and 2 are both illustrative of the structural examples of the heaters according to the embodiments of the present invention.
Figure 2:
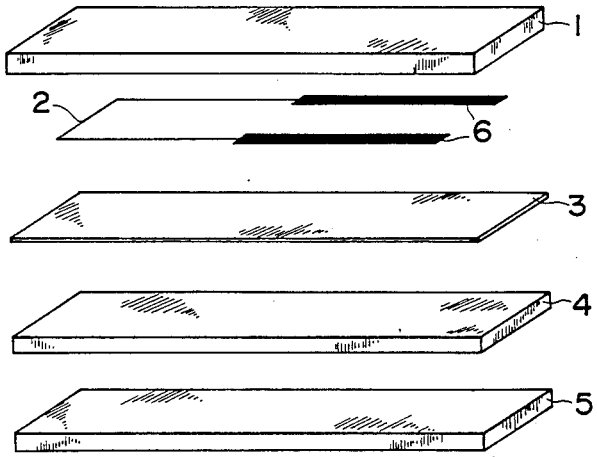

The heaters of the present invention usually comprise a basic structure composed of the $ZrO_2$-base substrate 4, $Al_2O_3$-base coating layer 3 and the electron-conductive pattern, i.e., heat-generating pattern 2 (or a terminal portion 6), said basic structure being sandwiched between two outer protective layers (usually of, e.g., $Al_2O_3$), as indicated in FIGS. 1 and 2. An additional outer protective layer 1, e.g., an outer alumina coat layer may be provided on the outer surface of the basic structure to provide improvements in durability and prevent warpage, etc. When an additional alumina coat layer is applied on one side of the basic structure, the application of a similar alumina coat layer 5 on the other side is useful for preventing warpage. However, it is to be understood that the embodiments of the present invention are not limited to those illustrated.

It is also to be noted that, in the production of the heaters of the present invention, the structural parts may independently be sintered for assembling, but it is preferred that, after lamination, all the layers are simultaneously sintered to improve the integrality therebetween.

Figure 3:
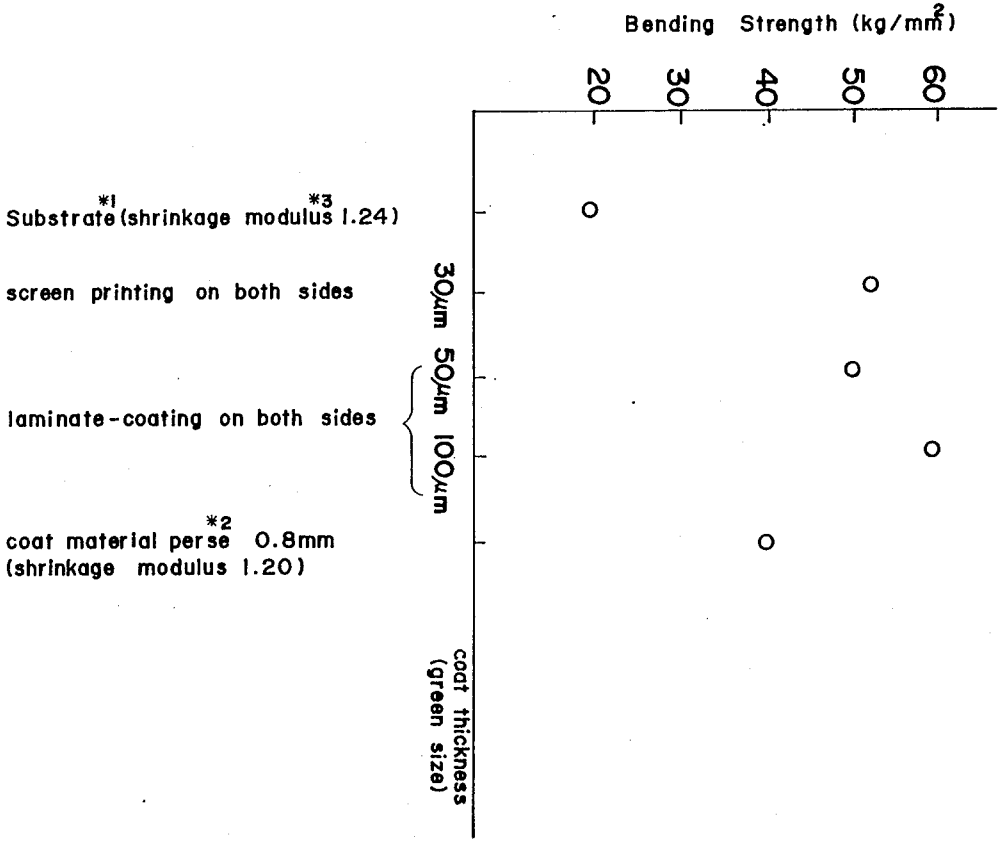
FIG. 3 is a graphic representation showing that the mechanical strength of the $ZrO_2$-base substrate is enhanced by the coating of $Al_2O_3$.

Preferably, the $Al_2O_3$-base material used in the present invention has a smaller sintering shrinkage modulus than the $ZrO_2$-base substrate since, in the simultaneous sintering, the $A_2O_3$ layer is densified owing to a contraction difference relative to the $ZrO_2$-base substrate material. If the ratio of the sintering shrinkage moduli of the $ZrO_2$base substrate to the $A_2O_3$ layer is selected from a range of 1.01:1 to 1.08:1, then both layers contract integrally during simultaneous sintering. In consequence, not only does densification of the $A_2O_3$ take place, but a compression stress is also produced in the $ZrO_2$-base substrate, resulting in further increases in the the mechanical strength thereof (see FIG. 3). More marked results are obtained, especially when the thickness of the $A_2O_3$ coating layer is 1/100 to 20/100 relative to the thickness of the $ZrO_2$-base substrate.

According to the present invention, it is possible to improve the insulating properties of $ZrO_2$ substrate heaters without substantial detriment to the durability and current efficiency thereof. It is further possible to enhance considerably the mechanical strength of the heaters.

In the following, the present invention will be explained with reference to the examples.

EXAMPLES (1) 94 mol % $ZrO_2$ (with the mean particle size being 0.8 microns) and 6 mol % $Y_2O_3$ (with the mean particle size being 0.3 microns) were wet-mixed together for 25 hours. To avoid incorporation of impurities, $ZrO_2$ balls were used for mixing.

(2) After drying, the resulting mixture was passed through a 60-mesh sieve, and was sintered at 1350° C. for 2 hours.

(3) With the balls used in step (1), the sintered product was pulverized for 50 hours into powders, 80 % or more of which had a grain size of 2.5 microns.

(4) After drying, the powders were mixed together for 10 hours, using as the solvent toluene, methyl ethyl ketone, etc.

(5) Thereafter, resin was mixed to prepare a sheet-like sample of 4.2 mm in green length, 4.8 mm in green width and 0.8 mm in green thickness by the doctor blade technique.

(6) Pt black 2: Pt sponge 1 were formulated into a paste with butyl carbidol etc. as the material for the electron-conductive pattern.

(7) Next, 92 wt % $Al_2O_3$, 3 wt % $ZrO_2$ and 3 wt % $SiO_2$ (and MgO, CaO) were formulated into a paste with butylcarbidol etc.

(8) The paste obtained in (7) was screen-printed on the sheet obtained in (5) into a thickness of about 50 microns. In Example 1 of Table 1, screen printing was applied to only the surface portion where the electron-conductive pattern portion is to be disposed, and in Example 2, screen printing was applied to the entire surface of the sheet.

(9) Thereafter, the Pt paste obtained in (6) was screen-printed into a thickness of about 30 microns to form a heat-gererating pattern 2 and a terminal pattern 6.

(10) Thereafter, the $A_2O_3$ paste obtained in (7) was screen-printed over the entire surface into a thickness of about 50 microns.

(11) After removal of the resin at 250° C. for 12 hours, sintering was carried out at 1515° C. for 4 hours.

(12) An $A_2O_3$ substrate of a shape similar to that of the examples was prepared, using as the raw material the alumina paste of (7). That substrate was coated with the Pt paste of (6), on which an $A_2O_3$ coat of 50 microns in thickness was applied to prepare an $A_2O_3$ substrate heater for the purpose of comparison.

(13) Current durability testing by applying a direct current of 17 V was carried out with the plate-like heaters prepared in the foregoing. The results are set forth in Table 1.

(14) At the initial stage of testing, direct current was passed at 14 V through each heater to measure the temperature thereof by means of a CA thermocouple spaced 1 mm apart from the heater surface. The temperature was about 700° C. for the heater of Example 1 and about 710° C. for the heater of Example 2. However, the heater for the comparison example showed 670° C.

TABLE 1

| | (Resistance Values: measured at room temperature) | | | | |
|---|---|---|---|---|---|
| | | Results | | | |
| Sample | Initial Resistance | after 50 hours | after 100 hours | after 150 hours | after 200 hours |
| *1 Example 1 | 3.8Ω | no change | no change | no color change Resistance 4.1Ω | no color change Resistance 4.3Ω |
| *2 Example 2 | 3.8Ω | no change | no change | no color change Resistance 4.1Ω | no color change Resistance 4.2Ω |
| *3 Example 3 | 3.9Ω | Coat portion becomes black Resistance 4.2Ω | peeling-off of coat portion Resistance 4.5Ω | Three of five samples disconnected | |

*1: $Al_2O_3$ was applied to only the portion beneath the electron-conductive pattern portion.
*2: $Al_2O_3$ was applied on the entire surface of the $ZrO_2$ substrate.
*3: $Al_2O_3$ substrate heater

What is claimed is:

1. A heater, comprising a partially and/or entirely stabilized $ZrO_2$-base substrate, an $Al_2O_3$-base insulating layer disposed on a surface of the substrate and having insulating properties at high temperature, and an electron-conductive pattern to generate heat disposed on said $Al_2O_3$-base layer, said substrate and insulating layer having been formed by simultaneous sintering, and wherein the $A_2O_3$ layer has a thickness of at least 20 microns.

2. A heater as defined in claim 1, wherein the sintering shrinkage modulus of the $Al_2O_3$-base insulating layer is smaller than that of the $ZrO_2$-base material forming the substrate.

3. A heater as defined in claim 2, wherein the ratio of the sintering shrinkage modulus of said $ZrO_2$-base layer to the sintering shrinkage modulus of the $Al_2O_3$-base layer is 1.01 : 1 to 1.08:1.

4. A heater as defined in claim 1, wherein the $Al_2O_3$-base insulating layer has a thickness of 1/100 to 20/100 relative to the $ZrO_2$-base substrate.

5. A heater as defined in claim 1, wherein further comprises at least one protective layer covering the electron-conductive pattern.

6. A heater as claimed in claim 1, wherein the $Al_2O_3$-base layer is formed directly on the $ZrO_2$-base substrate, and the $A_2O_3$ layer is in substantially continuous contact with the $ZrO_2$-base substrate.

7. A heater, comprising a partially and/or entirely stabilized $ZrO_2$-base substrate, an $Al_2O_3$-base layer disposed on a surface of the substrate and having insulating properties at high temperature, and an electron-conductive pattern to generate heat disposed on said $Al_2O_3$-base layer, and wherein the $A_2O_3$ layer has a thickness of at least 20 microns.

8. A heater as defined in claim 7, wherein the sintering shrinkage modulus of said $Al_2O_3$-base layer is smaller than that of $ZrO_2$-base material forming said substrate.

9. A heater as defined in claim 8, wherein the ratio of the sintering shrinkage modulus of said $ZrO_2$-base layer to the sintering shrinkage modulus of the $Al_2O_3$-base layer is 1.01:1 to 1.08:1.

10. A heater as defined in claim 7, wherein further comprises at least one protective layer covering the electron-conductive pattern.

11. A heater as defined in claim 7, wherein said $Al_2O_3$-base layer has a thickness of 1/100 to 20/100 relative to the $ZrO_2$-base substrate.

12. A heater as claimed in claim 7, wherein the $Al_2O_3$-base layer is formed directly on the $ZrO_2$-base substrate, and the $A_2O_3$ layer is in substantially continuous contact with the $ZrO_2$-base substrate.

* * * * *

UNITED STATES PATENT AND TRADEMARK OFFICE

CERTIFICATE OF CORRECTION

PATENT NO. : 4,806,739

DATED : February 21, 1989

INVENTOR(S) : Takao KOJIMA et al.

It is certified that error appears in the above-identified patent and that said Letters Patent is hereby corrected as shown below:

Col. 1, line 36, change "required or heating" to --required for heating-- line 66, delete "an embodiment wherein".

Col. 3, line 53, change "4.2 mm" to --42 mm--.

Col. 1, line 67; col. 2, lines 16, 17, 19, 68; col. 3, lines 3, 6, 11; and col. 4, lines 5, 10, 13, 14, change "$A_2O_3$" to --$Al_2O_3$--.

Claim 1, line 8; claim 6, line 3; and claim 7, line 6, change "$A_2O_3$" to --$Al_2O_3$--.

Signed and Sealed this

Seventeenth Day of April, 1990

*Attest:*

*Attesting Officer*

HARRY F. MANBECK, JR.

*Commissioner of Patents and Trademarks*